US010219603B2

(12) United States Patent
Tatin

(10) Patent No.: US 10,219,603 B2
(45) Date of Patent: Mar. 5, 2019

(54) PACKAGING FOR CONTAINING PRODUCTS, IN PARTICULAR COSMETIC PREPARATIONS

(71) Applicant: AXILONE PLASTIQUE, Auray (FR)

(72) Inventor: Christian Tatin, Larmor Plage (FR)

(73) Assignees: AXILONE PLASTIQUE, Auray (FR); PARFUMS CHRISTIAN DIOR, Paris (FR)

( * ) Notice: Subject to any disclaimer, the term of this patent is extended or adjusted under 35 U.S.C. 154(b) by 1098 days.

(21) Appl. No.: 13/721,684

(22) Filed: Dec. 20, 2012

(65) Prior Publication Data

US 2013/0161345 A1 Jun. 27, 2013

(30) Foreign Application Priority Data

Dec. 23, 2011 (FR) ..... 11 04084

(51) Int. Cl.
*A45D 40/00* (2006.01)

(52) U.S. Cl.
CPC .... *A45D 40/0068* (2013.01); *A45D 2200/051* (2013.01)

(58) Field of Classification Search
CPC .... B65D 45/322; B65D 45/02; B65D 47/063; B65D 81/20; B65D 81/2038; A45C 13/008; A45D 40/0068; A45D 2200/051
USPC ..... 220/830; 206/581, 235
See application file for complete search history.

(56) References Cited

U.S. PATENT DOCUMENTS 5,353,818 A * 10/1994 Suzuki ..... A45C 13/008 132/294
5,487,484 A * 1/1996 Bonniau ..... H05K 7/1417 220/201
5,896,866 A * 4/1999 Quennessen ..... A45C 13/008 132/293
5,957,317 A * 9/1999 Lee ..... B65D 81/2038 215/228
6,006,937 A * 12/1999 Baravaglio ..... A45D 40/0068 206/823

(Continued)

FOREIGN PATENT DOCUMENTS

EP 1468933 B1 5/2009
FR 1017922 A 12/1952

(Continued)

*Primary Examiner* — Anthony Stashick
*Assistant Examiner* — Blaine Neway
(74) *Attorney, Agent, or Firm* — Young & Thompson

(57) ABSTRACT

The packaging includes a container provided with an opening at the top and bounding a housing designed to receive the product, a lid designed to close the opening of the container and a deformable membrane borne by the lid to ensure the leak-tightness of the housing when the lid is in a closed position. The deformable membrane includes a generally flexible central wall surrounded by a generally rigid annular rim which is urged in the axial direction of closure by spring element bearing on a base of the lid such that the annular rim bears in a leak-tight manner on an annular bearing surrounding the opening of the container when the lid is in the closed position and the central wall may be deformed as a result of the differences in pressure prevailing on either side of the deformable membrane. The packaging may be used in particular for cosmetic preparations.

11 Claims, 3 Drawing Sheets

(56) References Cited

U.S. PATENT DOCUMENTS

| | | | | |
|---|---|---|---|---|
| 7,334,685 | B2 * | 2/2008 | Mathiez | A45C 13/008<br>132/293 |
| 8,261,934 | B2 * | 9/2012 | Salciarini | A45D 40/22<br>206/581 |
| 2002/0014434 | A1 | 2/2002 | Mathiez | |

FOREIGN PATENT DOCUMENTS

| | | | |
|---|---|---|---|
| WO | 0030491 | A1 | 6/2000 |
| WO | 2005039349 | A1 | 5/2005 |

* cited by examiner

PACKAGING FOR CONTAINING PRODUCTS, IN PARTICULAR COSMETIC PREPARATIONS

The invention relates to the packaging of products, in particular cosmetic preparations.

It relates more particularly to a packaging for containing a product, in particular a cosmetic preparation, comprising a container provided with an opening in its upper portion and bounding a housing for receiving the product, a lid designed to close the opening of the container and a deformable membrane borne by the lid to ensure that the housing is leak-tight when the lid is in a closed position.

Such packaging, also known as a "container", is used chiefly for the packaging of products containing volatile components, and in particular for cosmetic, pharmaceutical and like preparations.

It must be possible to keep these products in optimal conditions of leak-tightness in order to avoid losses of weight through exchanges with the external ambient environment.

In practice, changes in air pressure due to changes in weather or travel, for instance when being conveyed in an aircraft hold, generate air pressure differences between the interior and the exterior of the packaging.

In the event of a leak causing defective leak-tightness, these pressure differences tend to rebalance the hygrometry of the product by exchanges with its ambient environment, leading to a loss of weight.

Packaging of the above-mentioned type is known in which the lid is either screwed on the container or is articulated thereon by a hinge. However, no known packaging of this type makes it possible fully to satisfy the above requirements. Leak-tightness is generally ensured by joints exerting forces in the radial direction, which often requires a substantial screwing couple in the case of a screw lid or a substantial closing force when the lid is hinged. This kind of packaging is not therefore easy for users to manipulate both when closing and when opening the lid.

The object of the invention is in particular to provide a packaging of the above-mentioned type in which the user is able to open and close the lid in a satisfactory manner.

A further object of the invention is to provide a packaging of the above-mentioned type able to ensure leak-tightness over a wide temperature range, typically from −10° C. to +50° C., with a low weight loss by the product which it contains.

A further object of the invention is to provide such a packaging which is particularly suitable for the packaging of products containing volatile components, and in particular the packaging of cosmetic preparations.

To that end, the invention relates to a packaging for containing a product as defined above.

In accordance with the invention, the deformable membrane comprises a generally flexible central wall surrounded by a generally rigid annular rim, said annular rim being urged in an axial direction of closure by spring means bearing on a base of the lid. The annular rim thus bears in a leak-tight manner on an annular bearing disposed about the opening of the container when the lid is in its closed position and the central wall of the membrane may then be deformed as a function of the differences between the pressures prevailing on either side of the deformable membrane.

In the closed position, the lid ensures the leak-tightness of the packaging as a result of the deformable membrane whose annular rim is urged resiliently in the axial direction of closure by spring means. The annular rim is urged to bear on the annular bearing surrounding the opening which makes it possible to limit the pressure in the housing, forming a leak-tight chamber. This provides a flexible coupling absorbing differences in volume and attenuating the pressure exerted on the leak-tight zone. The spring means also make it possible to repair any defect in the planar nature of the interface between the annular bearing of the container and the annular rim of the deformable membrane.

Within the meaning of the invention, the term "packaging" is understood to designate different types of packaging or containers, such as flasks, pots, tubes, housings, etc. In the majority of cases, the packaging comprises a flat base to which a cylindrical wall, having a geometric contour whose shape is for instance circular, oval, elliptical, polygonal, etc., is attached. Such a packaging is open at the top in order to form the opening which receives the lid.

The spring means of the packaging of the invention thus make it possible to ensure a constant and reliable pressure in the leak-tight zone formed between the annular bearing of the container and the annular rim of the deformable membrane borne by the lid.

These spring means are able to absorb deformations and to withstand the internal pressure within the packaging.

These spring means must be appropriately calibrated in order to ensure a constant pressure as mentioned above.

The invention is not limited to a particular type of spring means. These means may in particular be metal, synthetic or gas springs.

In a preferred embodiment of the invention, these spring means comprise a plurality of helical springs acting by compression and disposed parallel to the axial direction of closure.

Use may also be made of spring means comprising at least one buffer of resiliently compressible elastomer material.

Other solutions may also be envisaged, for instance resilient blades made from metal or plastics material.

To help to improve leak-tightness, it is advantageous for the annular rim to be provided with a sealing joint, in particular a lip seal, designed to bear in a leak-tight manner against the annular bearing surrounding the opening of the container.

The deformable membrane is preferably formed by moulding of two materials comprising a first generally flexible material for the central wall and the sealing joint and a second generally rigid material for the annular rim.

In the invention, the deformable membrane is borne by the lid. To limit any play in translation of the annular rim, said annular rim is provided with a first retaining shoulder designed to come to bear on a second retaining shoulder formed within the lid, under the action of the spring means, when the lid is in an open position.

Thus, when the lid is in the closed position, the annular rim is slightly offset downwards towards the base of the lid while ensuring the compression of the spring means in order to help to achieve leak-tightness. In contrast, however, when the lid is brought into the open position, the spring means tend to facilitate opening by displacing the annular rim of the membrane in translation until it comes to bear as a result of the cooperation of the two shoulders mentioned above.

The central wall of the deformable membrane advantageously comprises a concertina periphery connected to the annular rim.

In the closed position of the lid, the central wall of the membrane is in a rest position spaced from the base of the lid when the pressure within the housing is equal to the pressure external to the packaging and in a working position against the base of the lid when the pressure within the housing is greater than the pressure external to the packaging.

According to a further feature of the invention, the lid bounds, in conjunction with the deformable membrane, a variable-volume compartment communicating externally via least one vent provided through the lid.

This helps to bring this compartment to the external pressure, i.e. the ambient pressure.

The lid of the invention may be completely independent from the container. It is preferable, however, for said lid to be connected to the container by a hinge.

In this way, not only is the lid impossible to lose, but the spring means also facilitate the opening of the lid by pivoting about the hinge.

It may be envisaged, however, to provide a lid cooperating with the container by screwing.

The container may itself directly form the housing for receiving the product.

It may also be envisaged for the container to house a tub which forms a housing for the product. In this case, the tub may have an external rim forming the annular rim around the opening.

In some cases, it is advantageous for the tub to be made from a material compatible with the nature of the product, for instance a cosmetic preparation, which material may then differ from the material forming the actual container.

According to a further feature of the invention, the container is provided with a detachable protective cover designed to close the housing.

In the following detailed description, given solely by way of example, reference is made to the accompanying drawings, in which.

Figure 1:
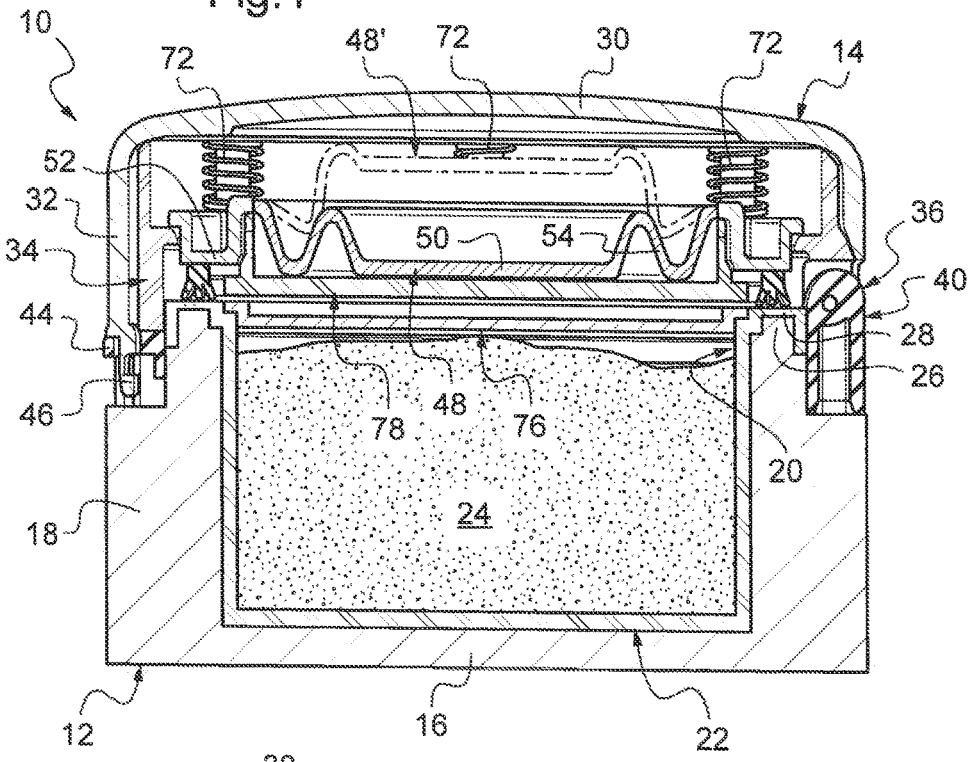
FIG. 1 is a diagrammatic view in section of a packaging of the invention whose lid is in the closed position, the membrane of the lid being shown in two different positions.

Reference is made first to FIG. 1 which shows a packaging 10 intended to contain a product, in particular a product with volatile components. This product may for instance be a cosmetic preparation of a cream or like type. The packaging comprises a container 12, for instance of the pot or tube type, and a lid 14 which, in the embodiment shown, is articulated on the container by means of a hinge which is described in detail below.

The container comprises a generally plane base wall 16 having a contour whose shape is selected to be, for instance, circular, oval, elliptical, polygonal, etc. This base wall is surmounted by a side wall 18 in order to define an open surface with an opening 20 at the top. In the embodiment shown, the container 12 is hollow and internally receives a tub 22 of appropriate shape which forms a housing 24 intended to receive the product to be packaged and conserved. Said tub 22 has an external rim 26 which forms an annular rim or bearing surrounding the opening 24. This annular rim thus has a plane annular surface which forms a seat in order to cooperate with the lid as described below.

In the embodiment shown, the container 12 and the tub 22 are made from different materials, the container 12 being made, for instance, from poly(methyl methacrylate) (PMMA) and the tub 22 from another material, for instance polypropylene, polyethylene or polyester, compatible with the product contained in the housing 24.

This tub thus makes it possible to form an inner lining in cases in which the material forming the container is not compatible with the nature of the product that it is to contain.

It may also be envisaged to use said tub as a refill.

In a variant (not shown), the container 12 may directly form the housing 24 for receiving the product, in which case the tub 22 is omitted.

In this case, the annular rim is formed directly by the upper rim 28 of the container around the opening 24. This rim then forms a seat for the lid 14.

The lid 14 comprises a base wall 30, in this case of slightly convex shape, which forms the base of the lid and is connected to a side wall 32 which has substantially the same contour as the side wall 18 of the container.

In the embodiment shown, the lid 14 is provided internally with an insert 34, in the form of an annular ring, which makes it possible to conceal the hinge.

The container 12 and the lid 14 are hinged together by a hinge 36 which comprises a first hinge portion 38 rigid with a ring 40 provided on the container and a second hinge portion 42 rigid with the insert 34. These two hinge portions are articulated together by a pivot 43.

Opposite the hinge, the ring 40 comprises a catch 44 cooperating with a hook 46 of the lid 14. As mentioned above, the insert 34 makes it possible to conceal the hinge of the lid. It may be envisaged, however, as a variant, to form the hinge portion 42 directly on the lid, in which case the insert 34 may be omitted.

The lid is provided internally with a deformable membrane 48 intended to ensure the leak-tightness of the housing, and therefore of the product that it contains, when the lid is in a closed position, as is the case in FIG. 1.

The deformable membrane 48 comprises a generally flexible central wall 50 surrounded by a generally rigid annular rim 52. The central wall 50 comprises a concertina periphery 54 making it possible to facilitate its deformation as a function of the pressure differences between the inner pressure in the housing and the external pressure, i.e. the ambient pressure.

Figure 2:
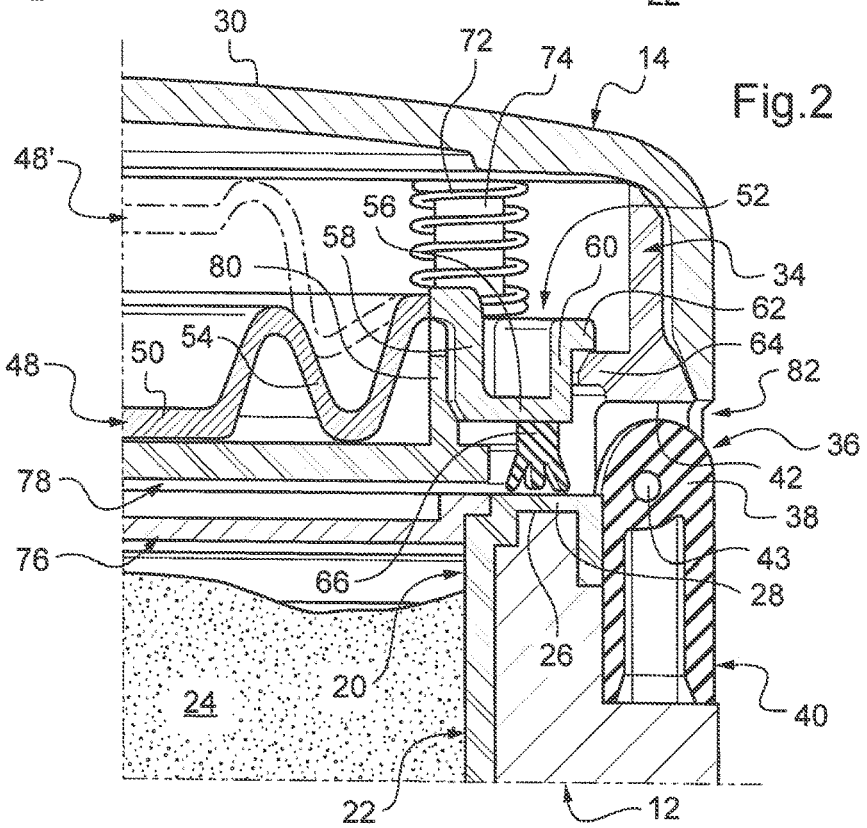
FIG. 2 is a detail of FIG. 1 shown on an enlarged scale.

In the embodiment shown, the annular rim 52 has a general U-shaped cross-section with a base 56, an inner arm 58 which is connected to the concertina portion and an outer arm 60 (FIG. 2). The arm 60 is prolonged towards the exterior by a first retaining shoulder 62 designed to come into contact with a second retaining shoulder 64 formed within the lid, and, in the embodiment shown, directly on the insert 34. The function of these two shoulders is to retain the deformable membrane 48 within the lid, and to limit its play in translation in the lid, as will be described below.

The annular rim 52 is provided with a sealing joint 66 made from flexible material. In the embodiment shown, it is a lip seal secured below the base 56 of the annular rim 52. The joint 66 is designed to bear in a leak-tight manner against annular bearing of the container, which forms a seat for the joint. In the embodiment shown, the joint comprises a central core surrounded by two lips, but other types of flexible joint may be envisaged.

The deformable membrane 48 may be produced by injection moulding of the dual material type, using a first generally flexible material for the central wall 50 and for the sealing joint 66 and a second generally rigid material for the annular rim 52.

The first material is preferably selected from among elastomers, such as thermoplastic elastomers, in particular of the styrene type. Non-limiting examples of the materials which may be used are those marketed under the names Thermolast® K or Tefabloc®.

The second material is preferably selected from among styrene polymers, in particular of the type of acrylonitrile butadiene styrene (ABS) or styrene-acrylonitrile (SAN), and rigid polymers.

The membrane 48 is subject to the action of resilient means formed, in the embodiment shown, by a plurality of helical springs 72 bearing, on one hand, on the base 30 of the lid and, on the other hand, on the annular rim 52 of the deformable membrane 48. These springs thus urge the annular rim 52 of the deformable membrane in an axial direction of closure, i.e. in a direction generally perpendicular to the plane defined by the sealing joint 66 of the lid and by the annular bearing 28 of the container when the lid is in the closed position. In the embodiment shown, these springs act by compression and are disposed parallel to the axial direction of closure.

In order to exert an appropriate and regularly distributed pressure, at least four springs are conventionally provided, six springs being shown in the embodiment, and are all appropriately spaced around the periphery of the annular rim 52. The springs 72 are made in this case from metal, for instance spring steel, and have an appropriate calibration force. Each spring receives, at one of its ends, a pin 74 moulded with the annular rim (FIG. 2). In this way, the springs cannot escape from the lid and urge the annular rim 52 to bear axially by cooperation between the retaining shoulders 62 and 64.

As shown in FIGS. 1 and 2, the container is provided with a detachable protective cover 76 designed to close the opening 20 of the container, i.e. in particular the tub 22.

The lid further comprises a mask or ornamental member 78 in the form of a flat disc surmounted by an annular rib 80 intended to fit within the annular rim 52, against the inner arm 58 of said rim. This mask is rigid with the lid and conceals the membrane.

The invention is not limited to a particular form of spring means. Use may be made of means other than helical compression springs, for instance one or a plurality of resiliently compressible elastomer buffers.

The buffer may be either a continuous buffer of annular shape disposed, for instance by adhesion, on the annular rim 52, or may be formed by spaced members.

It is also possible to use resilient blade springs of metal or plastics material or gas springs.

The leak-tightness between the lid and the container is thus ensured, in the closed position, by the joint 66 held in compression by the springs 72. The lid bounds, in conjunction with the deformable membrane, a variable-volume compartment which communicates externally via at least one vent 82 (FIG. 2) provided in the vicinity of the hinge. This compartment is therefore at the external pressure, i.e. at ambient pressure.

The deformable membrane 48 may be displaced between a rest position in which it bears on the ornamental member 78 and a working position in which it bears on the base 30 of the lid. The central wall of the membrane is in a rest position spaced from the base of the lid when the pressure $P_1$ within the housing is equal to the pressure $P_2$ external to the packaging. It is in a working position against the base of the lid when the pressure $P_1$ within the housing is greater than the pressure $P_2$ external to the packaging. These two positions are shown in FIG. 1: the membrane bears the reference numeral 48 in the rest position and the reference numeral 48' in the working position.

Consequently, if the packaging is placed in an atmosphere at reduced pressure, for instance in the hold of an aircraft, the atmospheric pressure $P_2$ becomes lower than the pressure $P_1$ in the housing of the container. Leak-tightness is then assured by the joint, and the membrane tends to move towards the position bearing against the base of the lid. It follows that if there is a leak, the joint will be urged back by the displacement of the membrane.

It is thus sufficient to use appropriately calibrated spring means to ensure leak-tightness in normal conditions of use between −10 and +50° C.

Moreover, the springs 72 help to facilitate manual opening and closing. When the lid is closed, the springs are compressed and the retaining shoulder 62 of the annular rim moves away from the retaining shoulder 64 of the lid, as is shown in FIG. 2.

When the user then wishes to open the lid, it is enough to press on the catch 44 which enables the lid to pivot about the axis of the hinge. The springs then tend to decompress and thus to push back the lid from the container thereby facilitating its opening.

Moreover, as the leak-tightness is provided in the axial direction of opening or closing, there is less resistance to opening or closing than in the case in which use is made of sealing means which operate in the radial direction as is the case with existing packaging.

Figure 3:
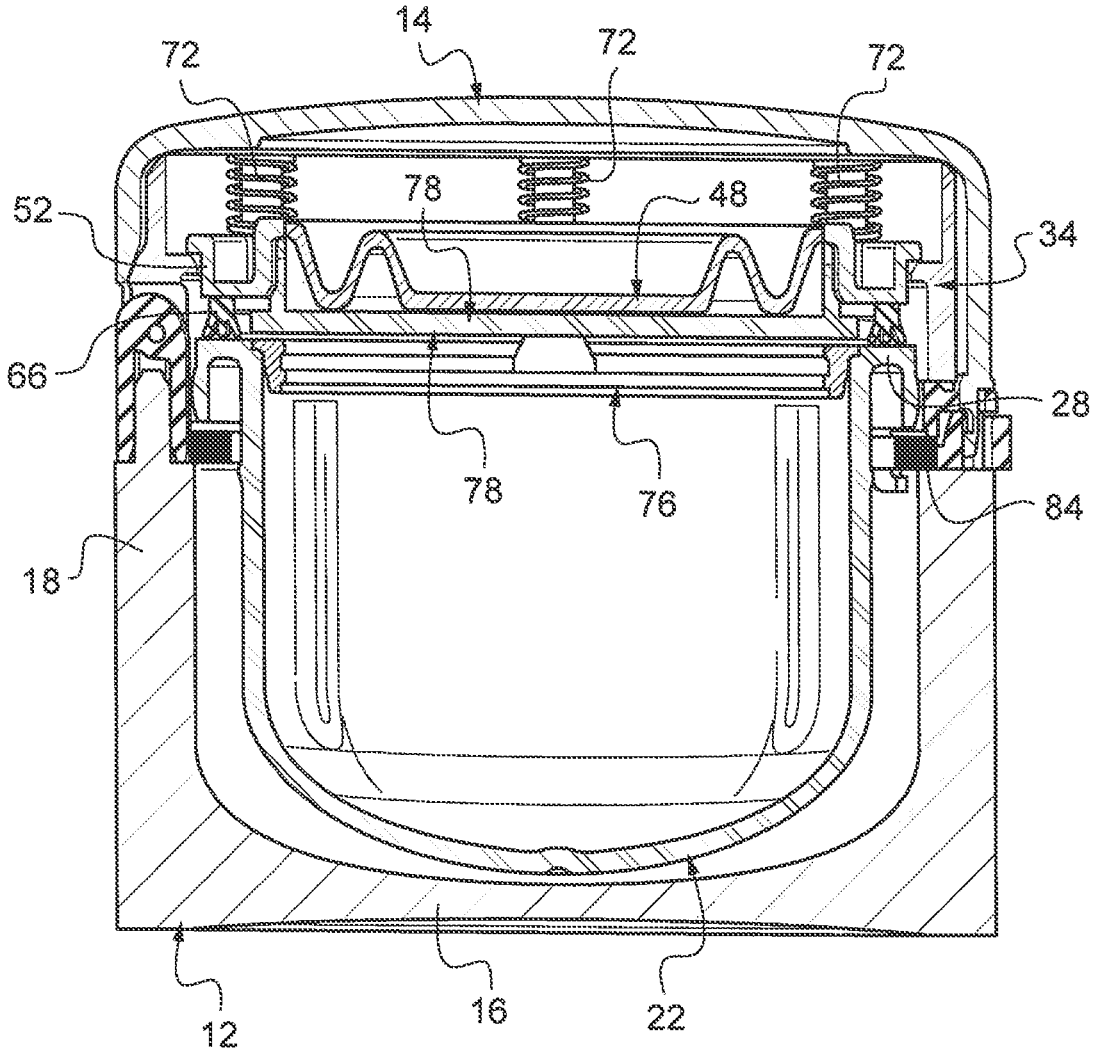
FIG. 3 is a view in section similar to FIG. 1 of a further packaging of the invention.
Figure 4:
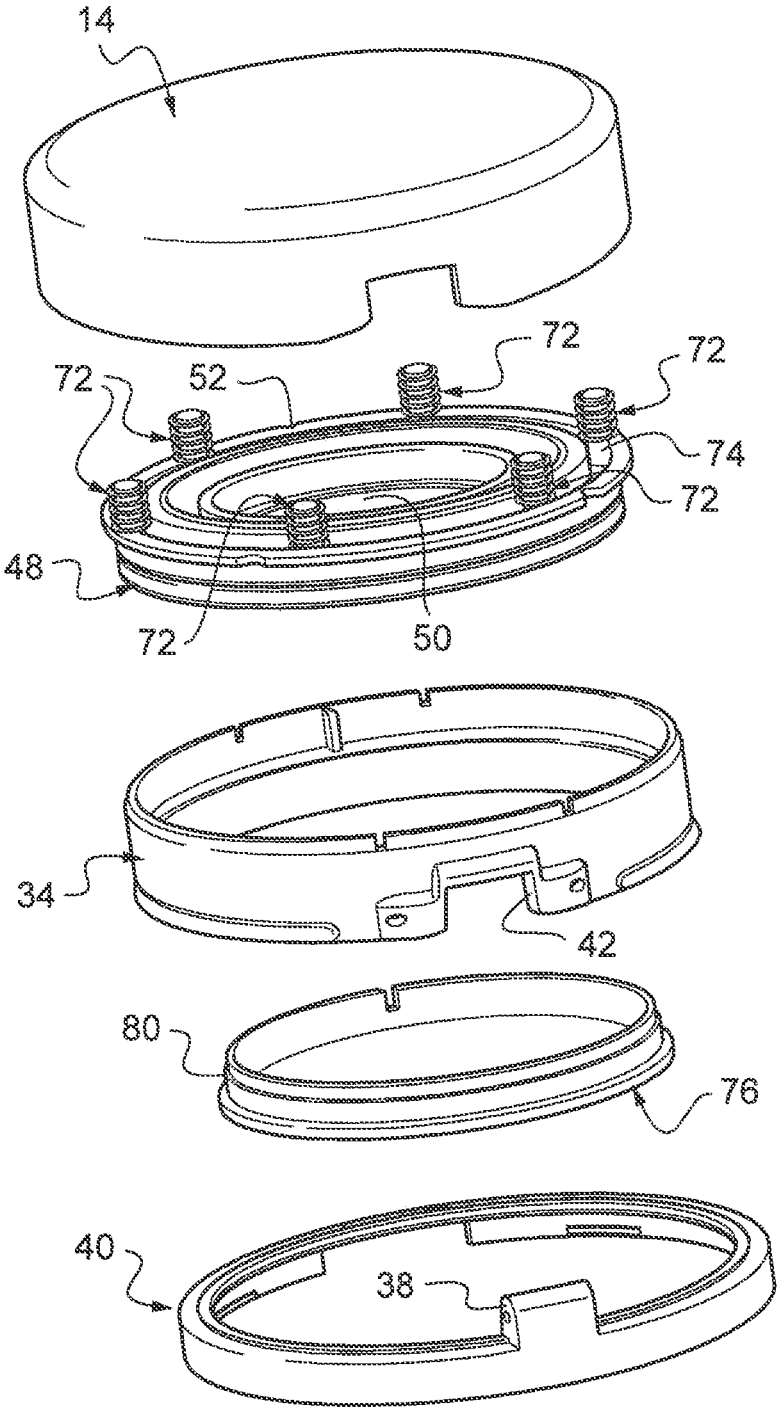
FIG. 4 is an exploded perspective view of the members of the lid of the packaging of FIG. 3.

Reference is now made to FIGS. 3 and 4 which show a further packaging which includes most of the members of the packaging of FIG. 1. Common members bear the same reference numerals. For reasons of simplification, only the main members of the packaging are shown in FIG. 3. FIG. 4 shows the various members making up the lid.

In the embodiment of FIGS. 3 and 4, the tub 22 has a rounder base and is kept spaced from the base wall 16 and the side wall of the container 12. A wedging insert 84 is also inserted between the recipient and the tub as can be seen in FIG. 3. This insert is advantageously made from a compressible material, for instance an elastomer.

FIG. 4 further shows that in this case there are six springs. As the container has a generally circular cylindrical wall, the springs may then be appropriately spaced with a mutual angular spacing of 60°.

The invention is not limited to the embodiments described and covers other variants. In particular, the spring means are not necessarily helical springs working by compression. Other mechanical springs, made from metal or plastics materials, or from elastomers, may be used. Similarly, the container is not necessarily designed to receive a tub, as the container may directly receive the product to be contained.

Moreover, as mentioned above, the lid is not necessarily connected by a hinge. The lid could be fully independent and be screwed onto and unscrewed from the container.

The invention is particularly applicable to the leak-tight packaging of products containing volatile substances, such as cosmetic creams or pharmaceutical preparations, although that list is not exhaustive.

The invention claimed is:

1. A packaging for containing a product, in particular a cosmetic preparation, comprising:

a container provided with an opening at the top and bounding a housing designed to receive the product, the container including an annular bearing surrounding the opening of the container, a lid designed to close the opening of the container, the lid including i) a base wall connected to a side wall, ii) a lid retaining shoulder located below the base wall and inwardly extending on an interior side of the side wall, the lid retaining shoulder having a top surface, an opposite bottom surface, and an inwardly facing side surface extending between the top and bottom surfaces, and iii) a deformable membrane that ensures leak-tightness of the housing when the lid is in a closed position, wherein the deformable membrane comprises a generally flexible central wall surrounded by a generally rigid annular rim translatable within the lid, the central wall being deformable as a function of pressure differences prevailing on either side of the deformable membrane, the annular rim comprising an outer arm with an outwardly directed membrane retaining shoulder, wherein the annular rim is provided with a sealing joint, designed to come to bear in a leak-tight manner on the annular bearing surrounding the opening of the container, plural springs that urge the annular rim in an axial direction of closure, the springs being spaced apart around a periphery of the annular rim and bearing on the base wall of the lid and on an upper part of the annular rim such that the annular rim bears in a leak-tight manner on the annular bearing surrounding the opening of the container when the lid is in the closed position, and wherein the outer arm and the outwardly directed membrane retaining shoulder are biased by the springs, when the lid is in an open position, to have an outwardly directed side surface of the outer arm be in contact with the inwardly facing side surface of the lid retaining shoulder and a lower surface of the membrane retaining shoulder be in contact with the upper surface of the lid retaining shoulder, wherein, in changing from the open position to the closed position of the lid, the outer arm and the membrane retaining shoulder move against the bias of the springs away from the lid retaining shoulder to a position with the outwardly directed side surface of the outer arm not being in contact with the inwardly facing side surface of the lid retaining shoulder and with the lower surface of the membrane retaining shoulder not being in contact with the upper surface of the lid retaining shoulder, and wherein the springs comprise a plurality of helical springs acting by compression and disposed parallel to the axial direction of closure, the springs being spaced apart around the periphery of the annular rim and bearing on the base wall of the lid and on an upper part of the annular rim, the lid bounding, in conjunction with the deformable membrane, a variable-volume compartment communicating externally via at least one vent provided through the lid, the lid being connected to the container by a hinge.

2. A packaging according to claim 1, wherein each of the helical springs receives, at one of its ends, a pin provided on the annular rim of the deformable membrane.

3. A packaging according to claim 1, wherein the springs comprise at least one buffer of resiliently compressible elastomer material.

4. A packaging according to claim 1, wherein the deformable membrane is formed by moulding of two materials comprising a first generally flexible material for the central wall and the sealing joint and a second generally rigid material for the annular rim.

5. A packaging according to claim 4, wherein the first generally flexible material is an elastomer and the second generally flexible material is a styrene polymer.

6. A packaging according to claim 1, wherein the central wall of the deformable membrane comprises a concertina periphery connected to the annular rim.

7. A packaging according to claim 1, wherein, in the closed position of the lid, the central wall of the deformable membrane is in a rest position spaced from the base of the lid when the pressure ($P_1$) within the housing is equal to the pressure ($P_2$) external to the packaging and the central wall of the deformable membrane is against the base of the lid when the pressure ($P_1$) within the housing is greater than the pressure ($P_2$) external to the packaging.

8. A packaging according to claim 1, wherein the hinge comprises a first hinge portion integral with a ring provided on the container and a second hinge portion integral with an insert provided in the lid.

9. A packaging according to claim 1, wherein the container receives a tub forming the housing for receiving the product, said tub having an external rim forming the annular bearing around the opening.

10. A packaging according to claim 1, wherein the container is provided with a detachable protective cover intended to close the housing.

11. A packaging according to claim 1, wherein the sealing joint is a lip seal, designed to come to bear in a leak-tight manner on the annular bearing surrounding the opening of the container.

* * * * *